US009434161B2

(12) United States Patent
Moens et al.

(10) Patent No.: US 9,434,161 B2
(45) Date of Patent: Sep. 6, 2016

(54) PRINT HEAD UNIT

(71) Applicant: OCÉ-TECHNOLOGIES B.V., Venlo (NL)

(72) Inventors: Marco T. R. Moens, Venlo (NL); Petrus W. A. M. Aerts, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/984,773

(22) Filed: Dec. 30, 2015

(65) Prior Publication Data

US 2016/0193836 A1 Jul. 7, 2016

(30) Foreign Application Priority Data

Jan. 7, 2015 (EP) ..... 15150243
Jun. 10, 2015 (EP) ..... 15171322

(51) Int. Cl.
*B41J 2/235* (2006.01)
*B41J 2/14* (2006.01)
*B41J 2/175* (2006.01)
*B41J 29/02* (2006.01)

(52) U.S. Cl.
CPC ..... *B41J 2/14072* (2013.01); *B41J 2/175* (2013.01); *B41J 2/235* (2013.01); *B41J 29/02* (2013.01); *B41J 2/14024* (2013.01); *B41J 2202/14* (2013.01); *B41J 2202/19* (2013.01)

(58) Field of Classification Search
CPC .. B41J 2/14072; B41J 2/235; B41J 2/14024; B41J 2202/19; B41J 2202/14
See application file for complete search history.

(56) References Cited

U.S. PATENT DOCUMENTS 4,682,188 A * 7/1987 Castellano ..... B41J 25/34 346/139 C
6,155,678 A 12/2000 Komplin et al.
6,302,601 B1 10/2001 Hagstrom et al.
6,328,415 B1 * 12/2001 Norton ..... B41J 25/304 347/37
7,401,899 B2 7/2008 Nelllen
7,419,242 B2 9/2008 Nellen
2011/0074849 A1 3/2011 Yamada et al.

FOREIGN PATENT DOCUMENTS

EP 0 440 261 A2 8/1991
EP 0646470 A2 4/1995
EP 2 772 360 A2 9/2014

* cited by examiner

*Primary Examiner* — Manish S Shah
*Assistant Examiner* — Yaovi M Ameh
(74) *Attorney, Agent, or Firm* — Birch, Stewart, Kolasch & Birch, LLP

(57) ABSTRACT

A print head unit comprises a print head for ejecting droplets of a marking material; an electronic print head controller; and a coupling assembly for mechanically coupling the print head and the print head controller; wherein the coupling assembly provides a first coupling state and a second coupling state, wherein in the first coupling state, the print head and the print head controller are fixed relative to each other; in the second coupling state, the print head and the print head controller are enabled to move relative to each other within a limited range.

The print head unit can be easily handled in the first coupling state, while in the second coupling state the print head may be mounted in a moving carriage without the print head controller affecting the position and rotation of the print head.

7 Claims, 6 Drawing Sheets

Fig. 1A
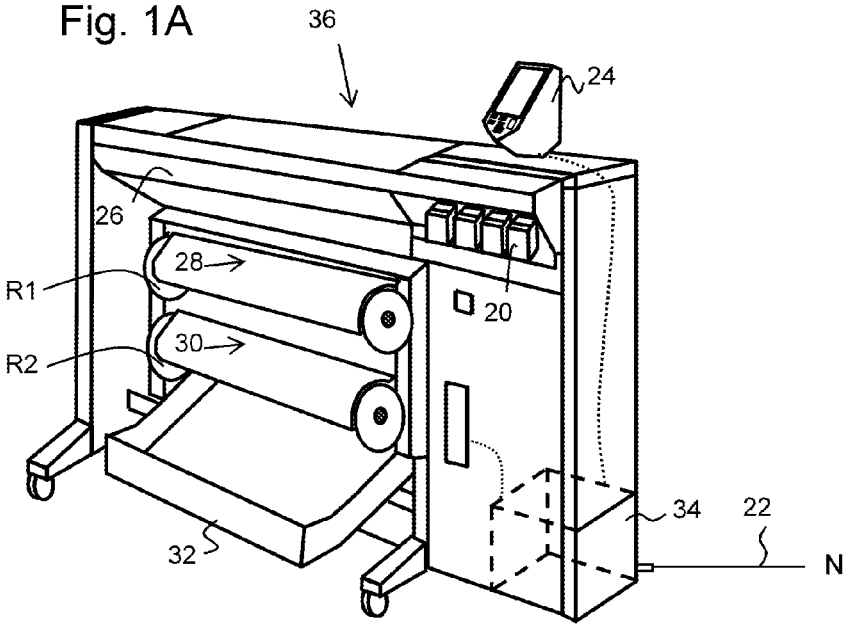
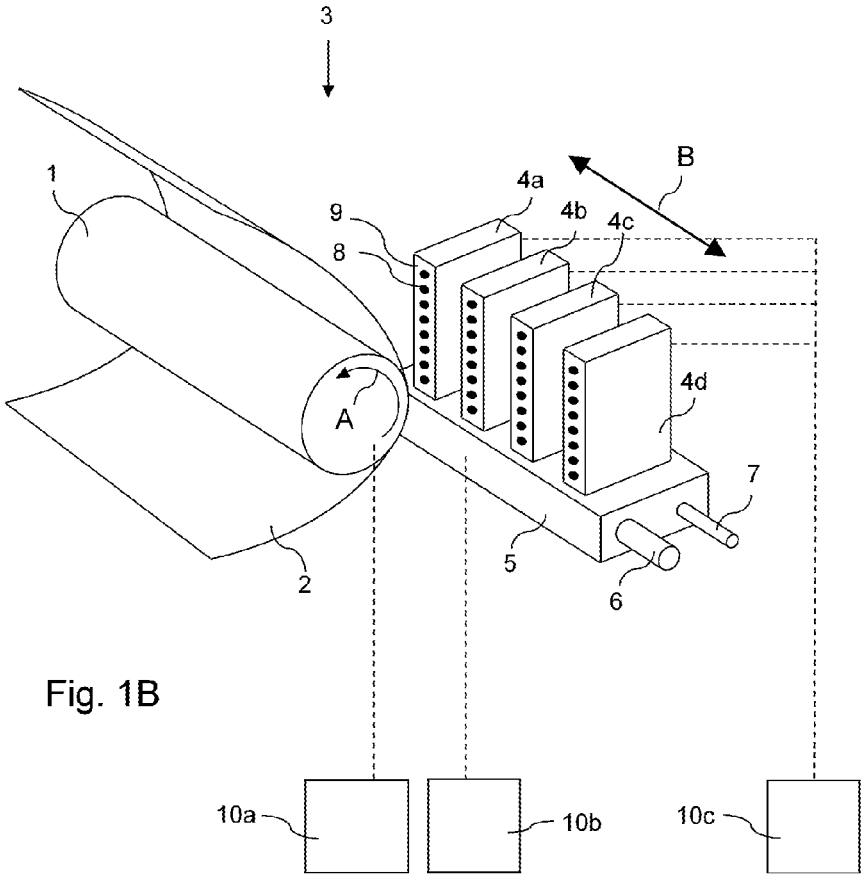
Fig. 1B

PRINT HEAD UNIT

FIELD OF THE INVENTION

The invention relates to a print head unit that includes a print head and an electronic print head controller. Further, the invention relates to a scanning inkjet printing assembly incorporating such a print head unit.

BACKGROUND ART

Inkjet print head units have a droplet forming unit, for example based on a piezo-electric actuator generating a pressure wave in a recording liquid such as an ink, the generated pressure wave resulting in a droplet of recording liquid being expelled through a nozzle, as is well known in the art. Further, for controlling the actuators, the print head unit may have an electronic print head controller. The print head controller may be configured to supply a suitable electric actuation signal to an actuator when a droplet needs to be expelled. Moreover, particular calibration data, specific for the droplet forming unit (hereinafter: the print head), may be stored in the print head controller such that the droplets that are expelled through the print head have optimal properties such as droplet size, shape, speed, and the like.

The presence of the print head controller increases the size of the print head unit considerably, while in a preferred embodiment, a number of print heads is arranged as close to each other as possible to minimize artefacts in the printed image. Therefore, it is known to position an electronic print head controller at a position away from the print head and even completely separate from the print head. This results in relatively long cabling with challenges in minimizing EMC-radiation effects. Further, with print head specific calibration data on the electronic print head controller, it may be preferred to have a dedicated print head controller per print head and therefore it may be desirable to have a direct mechanical coupling between the print head and the print head controller.

US2011/0074849A1 discloses a print head unit wherein a print head is mounted on a mounting member. Due to manufacturing tolerances, wirings to the print head may be rotated relative to the mounting member. In order to mount an electronic driver board on the mounting member, the mounting member provides for a rotatable holding element for holding the electronic driver board to compensate for the manufacturing tolerances. In an assembled state, the print head and the electronic driver board are fixed relative to each other.

To enable a dense arrangement of print heads, the electronic print head controller may be positioned adjacent to the print head. However, when mounted in a scanning (reciprocating) inkjet printing assembly, the weight of the print head controller may result in inertia forces acting on the print head. With the high demands on the accuracy of the droplet position and consequently on the pint head positioning, a complex and expensive mounting assembly may be required to ensure an accurate positioning and maintaining of such accurate print head position during printing for example as a result of the high accelerations during turning of direction of movement.

SUMMARY OF THE INVENTION

It is an object of the invention to provide a print head unit that may be cost-effectively and accurately positioned and mounted in a carriage of an inkjet printing assembly.

The object is achieved in a print head unit according to claim 1. The print head unit, comprising a print head and a print head controller electrically connected to the print head, further comprises a coupling assembly that mechanically couples the print head and the print head controller. Thus, the print head and the print head controller are dedicated to each other.

In an assembled state, the coupling assembly provides a first coupling state and a second coupling state. In the first coupling state, the print head and the print head controller cannot move relative to each other. This first coupling state is suitable for handling the print head unit when it is not mounted in a printing assembly. In the second coupling state, the print head is enabled to move within the range limited by the coupling assembly relative to the print head controller. This second coupling state is suitable for preventing the mechanical interaction between the print head and the print head controller, when the print head unit is mounted in a printing assembly. In particular, when the print head unit is mounted on a reciprocating carriage, the inertia of the weight of the print head controller will not influence the position of the print head. As the print head has to be positioned with high accuracy relative to the carriage and, therewith, relative to a recording medium that is, usually stepwise, moved through the printer, it is convenient that the print head, although it forms a print head unit with the controller, is movably attached to the print head controller, so that the print head and the print head controller are positioned and mounted (i.e. held in position) independently of one another.

In a high performance printer, the print head assembly may comprise a plurality of print head units arranged adjacent and close to one another, each of the print heads having its own controller. Each print head has a droplet ejection side where the droplets are ejected. To arrive at a relatively small footprint, it may be desirable that the print head controller is arranged—relative to the print head—such that the print head controller is at an opposite side of the print head compared to the droplet ejection side. The footprint of the carriage in a plane parallel to a print surface on which the recording medium is arranged does not increase due to the presence of the print head controller. On the other hand, a centre of mass of each print head unit is shifted away from the print head, resulting in inertia forces acting on the print head such that a torque acts on the print head. Such a torque may affect the rotational position of the print head and consequently a direction of flight of ejected droplets. As the direction of flight of the droplets determines the location on the recording medium, any torques on the print head are preferably prevented. Mechanically decoupling the print head and the print head controller when mounted in the carriage prevents such torque and minimizes any inertia forces acting on the print head. In effect, requirements on a mounting mechanism holding the print head are alleviated.

In an embodiment, the coupling assembly comprises a snap-fastening mechanism, wherein the snap-fastening mechanism is fastened in the first coupling state and wherein the snap-fastening mechanism is decoupled in the second coupling state. Such a snap-fastening mechanism eases the handling of the print head unit, when switching between the first and the second coupling state.

In another embodiment, the coupling assembly comprises a magnetic fastening mechanism. In the first coupling state the magnetic fastening mechanism is arranged for generating a magnetic fastening force on the print head and the print head controller for driving them towards and/or against one another. In the first coupling state the magnetic force pulls the print head and the print head controller together. In the second coupling state the magnetic fastening force is absent or very small, since it is significantly reduced with respect to the first coupling state.

In an embodiment the magnetic fastening mechanism comprises a magnetic element, such as a magnet, on either the print head or the print head controller. This magnetic element can be a permanent magnet, an electromagnet, etc. A magnetisable element is provided on the other one of the print head and the print head controller and the magnetic element and the magnetisable element are arranged, such that when near or adjacent one another the magnetic fastening force drives the magnetic element and the magnetisable element towards one another. The magnetisable element is arranged to interact with the magnetic element for generating the magnetic fastening force and can be a second magnet, or made of a magnetisable material like ferromagnetic materials such as steel.

In an embodiment, the magnetic element and the magnetisable element are provided on correspondingly shaped mating parts of the print head and the print head controller for constraining movement of the print head with respect to the print head controller in a direction substantially perpendicular to the magnetic fastening force in the first coupling state. One mating part can be an extension which is shaped correspondingly to the other mating part, which can be a recess. Preferably said extension and recess extend from the print head or print head controller parallel to the direction of the magnetic fastening force.

In an aspect, the present invention further provides a scanning inkjet printing assembly, wherein the inkjet printing assembly comprises a carriage that is moveably arranged to scan over a recording medium. The carriage is provided with a first mounting mechanism and a second mounting mechanism. The printing assembly is further provided with a print head unit according to the present invention and the print head unit is mounted in the carriage. The print head is engaged by the first mounting mechanism and the print head controller is engaged by the second mounting mechanism. Thus, the first mounting mechanism may be designed to accurately position and hold the print head, while the second mounting mechanism may be simpler and more cost-effective as the print head controller is not required to be highly accurately positioned. The second mounting mechanism is mainly intended to hold the print head controller such that its inertia forces do not affect the position of the print head.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A is an exemplary embodiment of a printer assembly employing a scanning inkjet printing assembly according to FIG. 1B;

FIG. 1B is a schematic representation of an exemplary embodiment of a scanning inkjet printing assembly;

DETAILED DESCRIPTION OF THE DRAWINGS

Figure 2A:
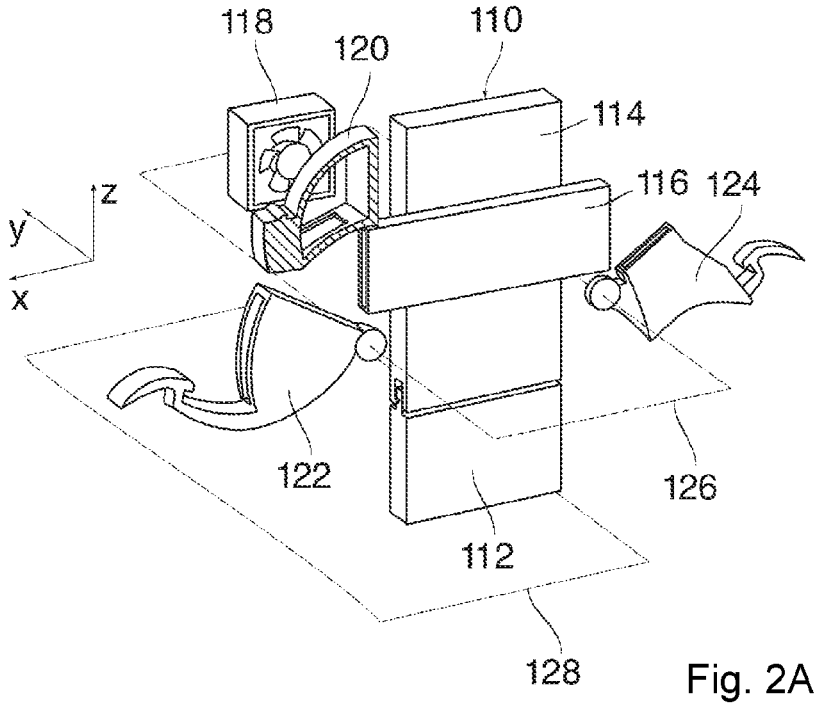
FIG. 2A is an exploded perspective view showing an embodiment of a printing assembly in which a print head unit according to the invention is applied.

FIG. 1A shows an image forming apparatus 36 (herein also referred to as a printer assembly), wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32. Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material. A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2B:
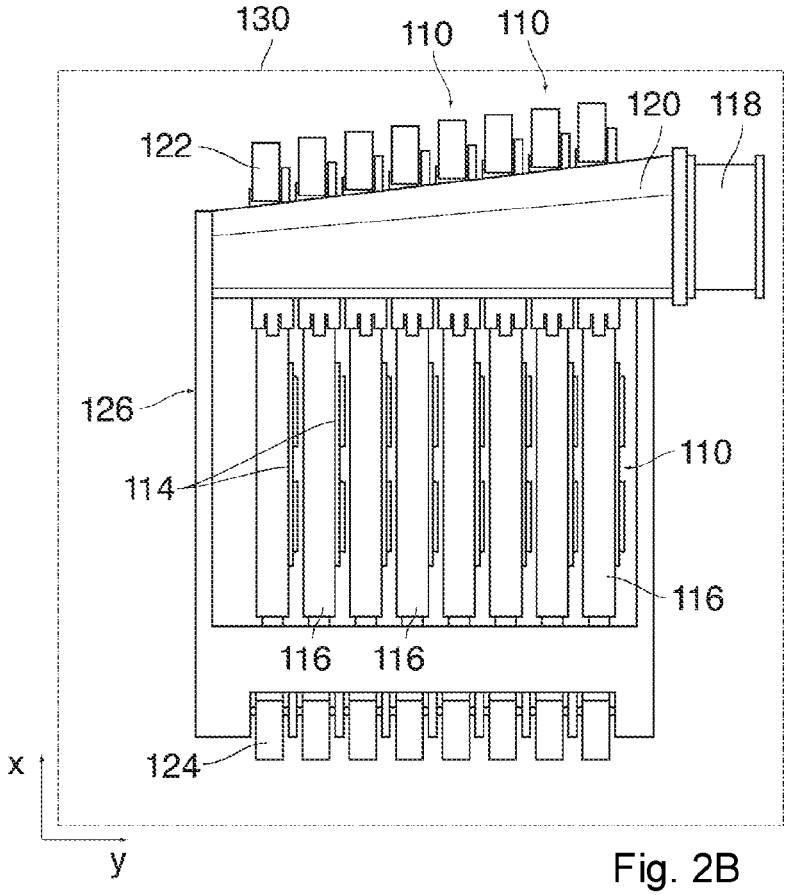
FIG. 2B is a top plan view of a printing assembly according to FIG. 1 comprising a plurality of print head units.

As is shown in FIGS. 2A and 2B, a print head assembly comprises a print head unit 110 which, in accordance with the present invention, is formed of a print head 112 and a print head controller 114. The assembly further comprises a cooling duct 116 to which the print head controller 114 is attached, a suction blower 118 and a plenum chamber 120 of which only a slice has been shown in FIG. 2 and which is arranged to connect the blower 118 to one end of the cooling duct 116.

An exit side clamp 122 and an entry side clamp 124 are pivotally mounted on a frame 126 (shown only in phantom lines in FIG. 2A) and can be pivoted into respective positions in which they straddle the opposite ends of the cooling duct 116 so as to secure the cooling duct and the print head controller 114 on the frame 126. The exit side clamp 122 has the additional function of establishing fluid communication between one end of the cooling duct 116 and the plenum chamber 120.

In this example, it shall be assumed that the print head 112 is an ink jet print head having, in a bottom end face that is not visible in FIGS. 2A and 2B, a row of nozzles that extends in a direction x, whereas the frame 126 forms part of a reciprocating carriage 130 (shown in phantom lines in FIG. 2B) that travels in a direction y normal to the direction x. The nozzles of the print head 112 are facing a sheet 128 of a recording medium (shown in phantom lines in FIG. 2A) that is advanced step-wise in the direction x.

The print head 112 and the controller 114 are disposed adjacent to one another in a direction z normal to the x-y-plane. The print head 112 and the controller 114 are snap-fastened together so that, on the one hand, they can be handled as a single unit (the print head unit 110), but on the other hand are movable relative to one another within a range limited by the coupling as below elucidated in more detail. This permits to precisely adjust the print head 112 relative to the path of the recording medium 128 by means of an adjusting mechanism that has not been shown here, the adjustment being independent of the position of the controller 114 that is determined by the clamps 122, 124 holding the cooling duct 116. A suitable adjusting mechanism for adjusting a position of the print head 112 is well known from the prior art. As an example, a suitable exemplary adjusting mechanism is disclosed in U.S. Pat. No. 7,401,899 and/or U.S. Pat. No. 7,419,242.

FIG. 2B is a top plan view of the frame 126 as mounted on the reciprocating carriage 130 (shown in phantom lines only). The frame 126 accommodates a plurality of print head units 110, e.g. for different colours. Each print head unit 110 has its own cooling duct 116 and its own clamps 122, 124 arranged in the basic configuration as shown in FIG. 2A, whereas the blower 118 and the plenum chamber 120 are common to all print head units.

The plenum chamber 120 interconnects the exit side clamps 122 of all units when these clamps are connected to the open end of the associated cooling ducts 116. The plenum chamber is tapered towards the end facing away from the blower 118 so as to create an essentially uniform suction pressure at the end of each cooling duct 116.

It is noted that the assembly as shown in FIGS. 2A and 2B is merely an exemplary embodiment. The invention may as well be embodied without the cooling ducts 116 and related elements (i.e. blower 118, plenum chamber 120, and clamps 122, 124) for generating an air flow through the cooling ducts 116.

Figure 3A:
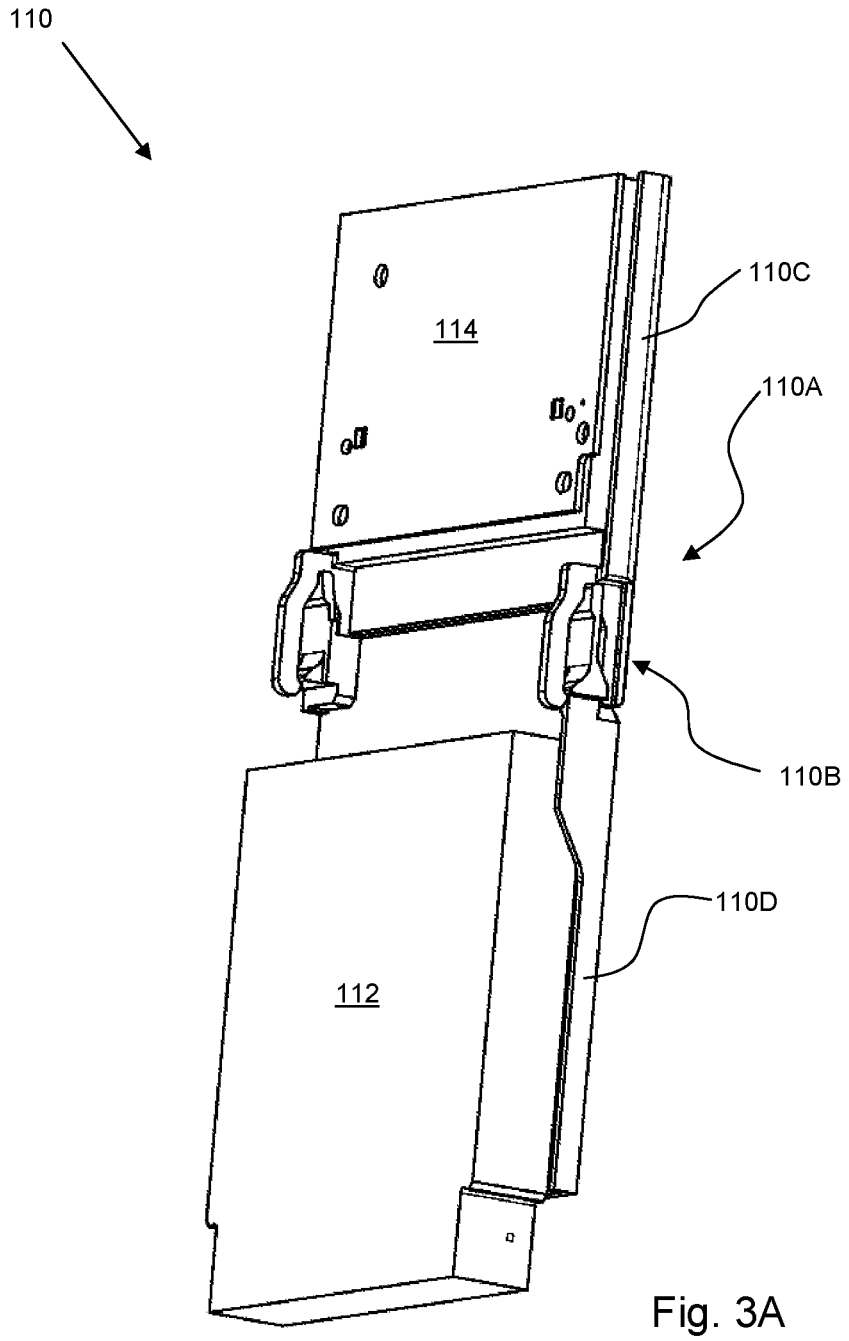
FIG. 3A is a perspective view of an embodiment of a print head unit in an assembled state according to the present invention.

An embodiment of the print head unit 110 is illustrated in FIG. 3A. The print head unit 110 as illustrated comprises a coupling assembly, a print head 112 and a print head controller 114. The coupling assembly comprises an unit frame 110A consisting of two frame parts 110C, 110D which are coupled, but are moveable relative to each other within a predetermined range, and the coupling assembly comprises a snap-fastening mechanism 110B. The two frame parts 110C, 110D may be fixed relative to each other using the snap-fastening mechanism 110B, which is illustrated in FIGS. 3B and 3C in more detail, in a first coupling state or the two frame parts 110C, 110D may be moveable relative to each other in a limited range in a second coupling state.

Figure 3B:
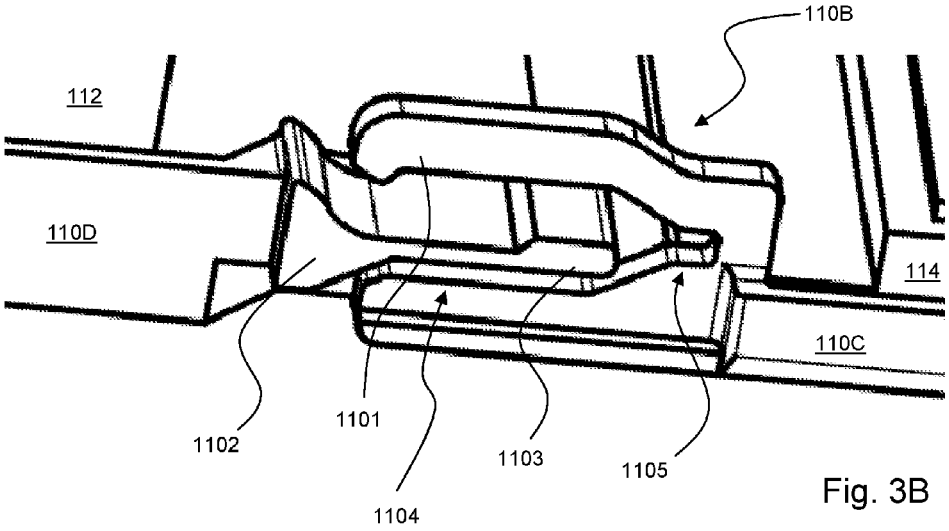
FIG. 3B is a perspective view of a snap-fastening mechanism as used in the embodiment of FIG. 3 in a decoupled state.
Figure 3C:
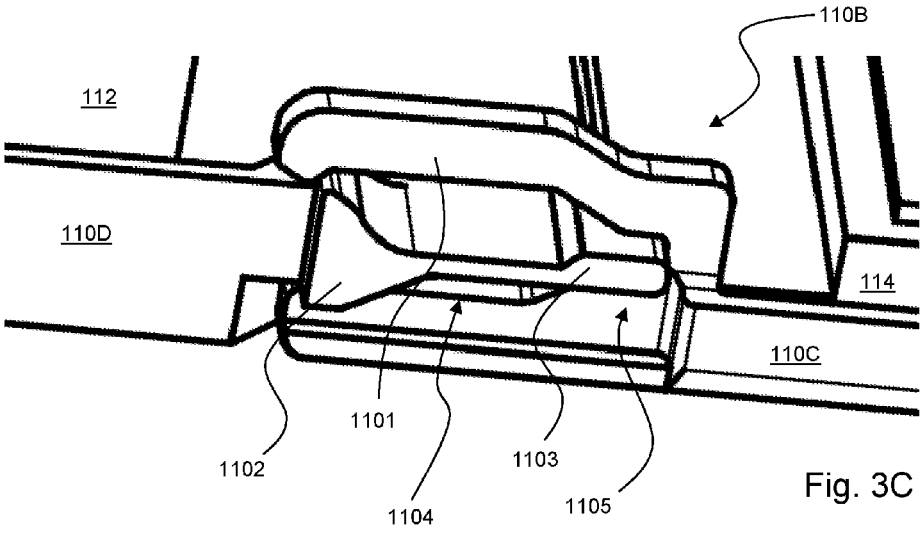
FIG. 3C is a perspective view of a snap-fastening mechanism as used in the embodiment of FIG. 3 in a coupled state.

As shown in FIGS. 3B and 3C, the snap-fastening mechanism 110B comprises a clamping arm 1101 connected to the print head controller 114 and a mating part having a ridge portion 1102 and a tip portion 1103. The mating part is positioned and kept in a holding space defined by the clamping arm 1101 and the frame part 110C holding the print head controller 114. The holding space has a widened portion 1104 and a narrowed portion 1105. The narrowed portion 1105 has a width that is substantially the same as a thickness of the tip portion 1103 such that the tip portion 1103 just fits in the narrowed portion 1105.

In FIG. 3B, the print head unit 110 is in the second coupling state. The ridge portion 1102 is positioned outside the holding space, while the tip portion 1103 is positioned in the widened portion 1104. The tip portion 1104 is enabled to move within a limited range defined by the holding space between the frame part 110C and the clamping arm 1101. Due to this limited freedom of the tip portion 1103 and the ridge portion 1102, the print head 112 is moveable relative to the print head controller 114.

In FIG. 3C, the print head unit 110 is in the first coupling state. The frame part 110D holding the print head 112 is moved (compared to the second coupling state shown in FIG. 3B) towards the frame part 110C holding the print head controller 114. The ridge portion 1102 is thereby moved into the holding space and the tip portion 1103 is moved into the narrowed portion 1105. The clamping arm 1101 is provided with a hook end and the clamping arm 1101 is resilient. Thus, the clamping arm 1101 is enabled to engage the ridge portion 1102 keeping both frame parts 110C, 110D fixed together. The tip portion 1103 is not able to move anymore as the tip portion 1103 is held in the narrowed portion 1105, taking away the ability for both frame parts 110C, 110D to move relative to each other. With a slight bending movement, the clamping force of the clamping arm 1101 may be overcome and the two parts 110C, 110D may be brought into the second coupling state again.

Figure 4A:
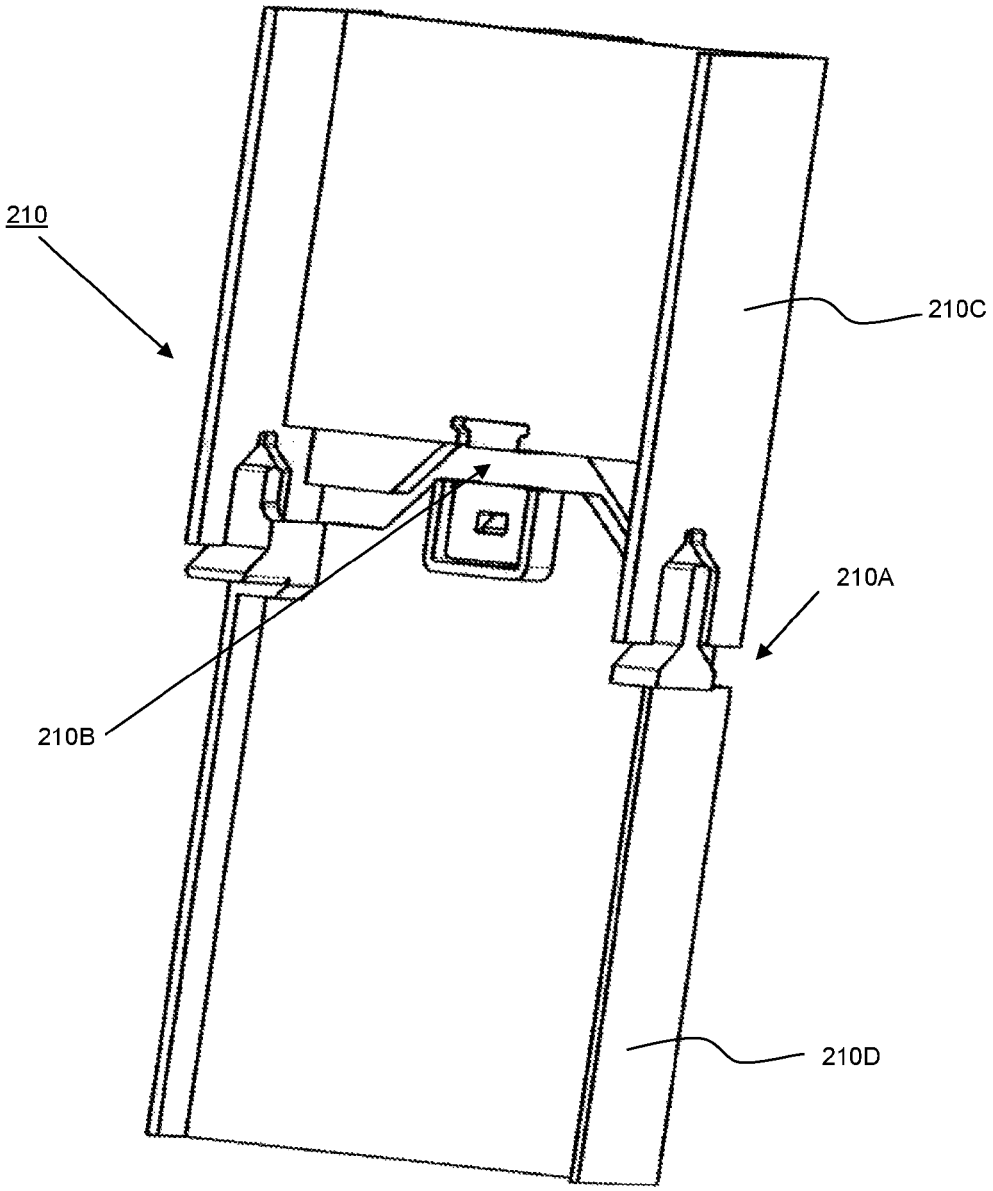
FIG. 4A is a perspective view of an embodiment of a unit frame in an assembled state with a magnetic fastening mechanism according to the present invention.

An alternative embodiment of a print head unit 210 according to the invention is illustrated in FIG. 4A. For clarity FIGS. 4A-E show only the unit frame 210A, and not the print head and the print head controller. The frame part 210C is arranged for holding the print head controller, while the frame part 210D is arranged for holding the print head. The print head unit 210 as illustrated comprises a coupling assembly comprising an unit frame 210A consisting of two frame parts 210C, 210D which are coupled, but are moveable relative to each other within a predetermined range, and the coupling assembly comprises a magnetic fastening mechanism 210B. The print head and the print head controller (not shown) may be provided on their respective frame parts 210C, 210D and may thus be fixed relative to each other using the magnetic fastening mechanism 210B, which is illustrated in FIGS. 4B to 4E in more detail, in a first coupling state or the two frame parts 210C, 210D may be moveable relative to each other in a limited range in a second coupling state.

Figure 4B:
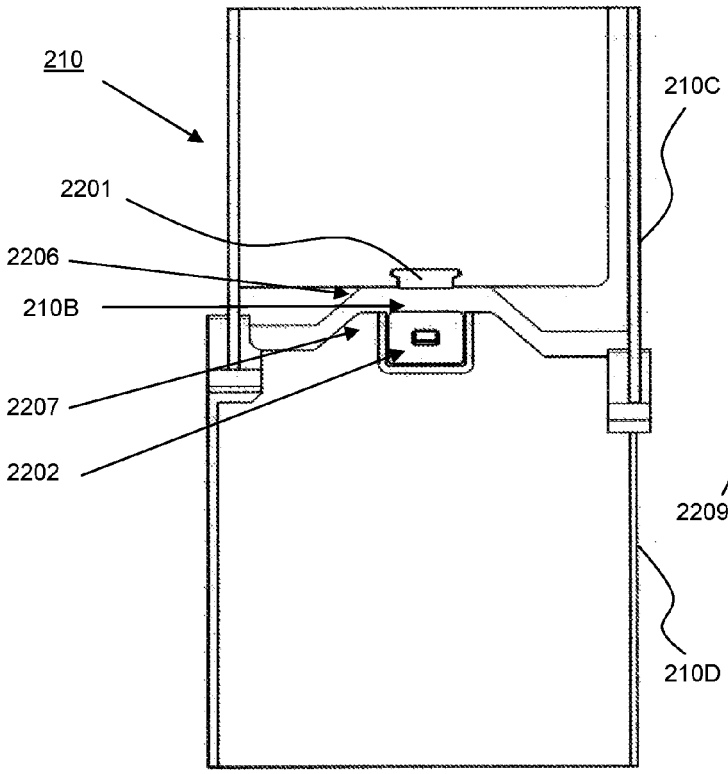
FIG. 4B is a front view of the unit frame with the magnetic mechanism as used in the embodiment of FIG. 4A in a decoupled state.
Figure 4C:
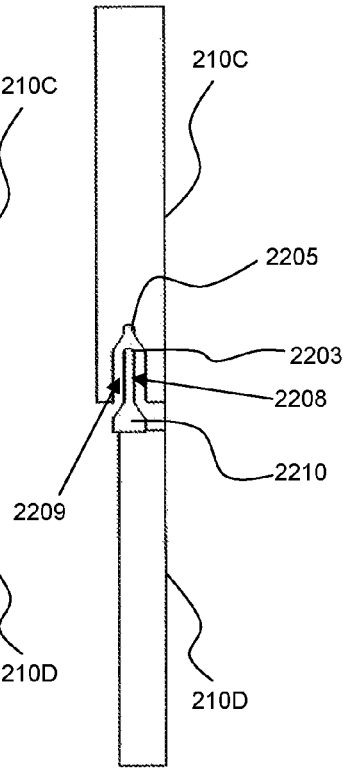
FIG. 4C is a side view of the unit frame with the magnetic mechanism as used in the embodiment of FIG. 4A in a decoupled state.
Figure 4D:
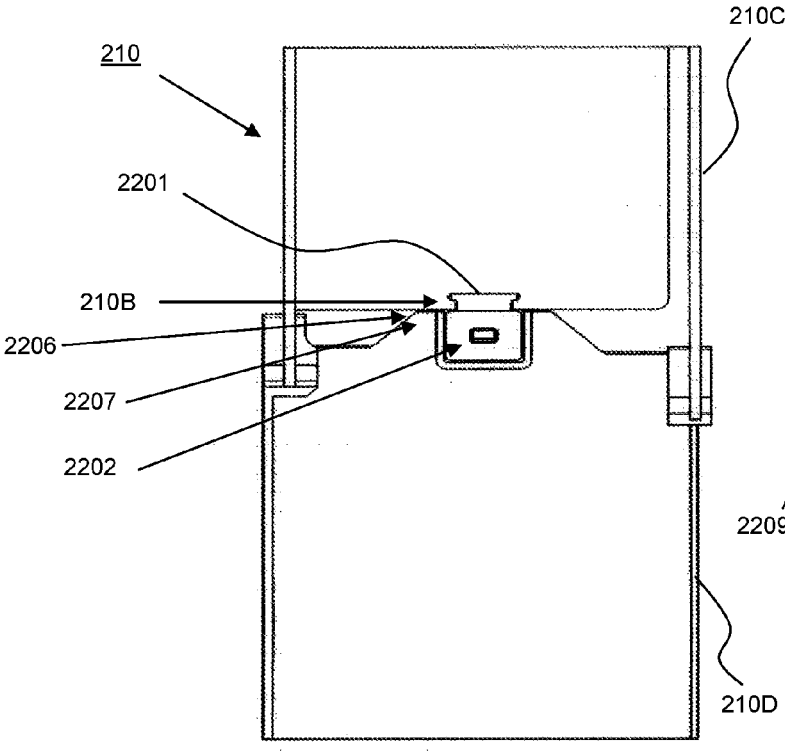
FIG. 4D is a front view of the unit frame with the magnetic mechanism as used in the embodiment of FIG. 4A in a coupled state.

As shown in FIGS. 4B and 4D, the magnetic fastening mechanism 210B comprises a magnetic element 2201 connected to the print head controller 214. In FIGS. 4B and 4D the magnetic element 2201 is a permanent magnet 2201 or electromagnet 2201 positioned at an edge of the frame part 210C for holding the print head controller, preferably near or in the middle of said edge. At the edge of the frame 210D near or adjacent the magnet 2201 a magnetisable element 2202 is provided, which is arranged to interact with the magnetic element 2201 for forming a magnetic locking system 2201, 2202. The magnetisable element 2202 is arranged to be attracted to the magnetic element 2201, such that when both elements 2201, 2201 are in proximity or adjacent a magnetic force is generated pressing both elements 2201, 2202 together. The magnetisable element 2202 can be formed any magnetisable material, e.g. steel. In a simple embodiment the magnetisable element 2202 is formed as a steel plate 2202.

The edge frame part 210C where the magnet 2201 is located is provided with a recess or notch 2206, which forms a holding space 2206 for a correspondingly formed extension 2207 on an edge of the frame part 210D. The corresponding extension 2207 is arranged to slide and be positioned fittingly in the recess 2206, when under the magnetic interaction of the magnetic fastening mechanism 210B the frame parts 201C and 201D are brought together. Securing the extension 2207 in the holding space 2206 forms a secure fastening preventing the connected frame parts 210C and 210D from moving apart. One or more holding spaces 2206 and extensions 2207 can be provided along the respective edges of the frame part 201C and 210D. Different configurations of the mating parts 2206, 2207 can be imagined within the scope of the present invention.

The magnetic fastening mechanism 210B further comprises a longitudinal protrusion 2208. In FIGS. 4A-E the protrusion 2208 comprises a tapered base 2210 which extends into a straight section with at its free end a tip portion 2203. The protrusion 2208 extends in the direction of the magnetic force exerted by the magnetic fastening mechanism 210B. In FIG. 4A-E protrusions 2208 are provided at both sides of the frame part 210D. On the frame part 210C U-shapes defining corresponding receiving spaces 2209 are provided for receiving and holding the protrusions 2208. Each receiving space 2209 comprises a straight section connected to a tapered section which ends in a narrowed portion 2205. The protrusion 2208 is able to slide into the receiving space 2209, such that its tip portion is received and clamped in the narrowed portion 2209. The narrowed portion 2205 has a width that is substantially the same as a thickness of the tip portion 2203 such that the tip portion 2203 just fits in the narrowed portion 2205. Thus an additional holding force is provided. Preferably the tapered base 2210 of the protrusion 2208 is, in the first coupling state, in contact with the free ends of the legs of the U-shaped receiving space 2209 to provide additional stability.

In FIGS. 4B and 4C and, the print head unit 210 is in the second coupling state. The steel plate 2202 is positioned outside the holding space 2206, while the tip portion 2203 is positioned in the widened portion of the receiving space 2209. The tip portion 2203 is enabled to move within a limited range defined by the receiving space 2209 between the two legs of the U-shaped region. Due to this limited freedom of the tip portion 2203 and the steel plate 1102, the print head 212 is moveable relative to the print head controller 214.

Figure 4E:
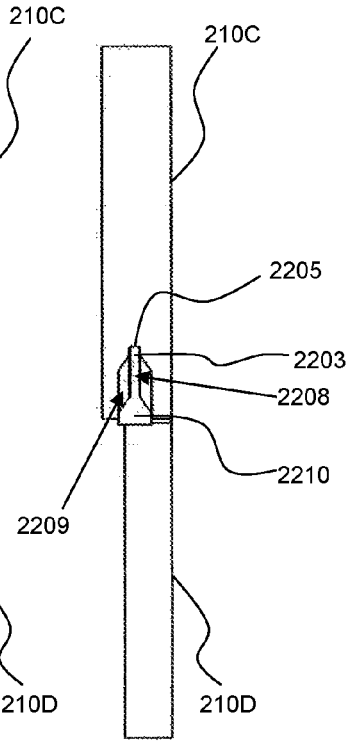
FIG. 4E is a side view of the unit frame with the magnetic mechanism as used in the embodiment of FIG. 4A in a coupled state.

In FIGS. 4D and 4E, the print head unit 210 is in the first coupling state. The frame part 210D for holding the print head is moved (compared to the second coupling state shown in FIGS. 4B and 4C) towards the frame part 210C for holding the print head controller. The steel plate 2202 is thereby moved into the holding space formed by the recess 2206 and the tip portion 2203 is moved into the narrowed portion 2205. The magnetic force as well as the clamping force on the tip portion 2203 keeps the frame parts 210C, 210D fixed together. The tip portion 2203 is not able to move as the tip portion 2203 is held in the narrowed portion 2205, while the extension 2207*b* with the magnetisable material 2202 is held with the recess 2206 by the magnet 2201, taking away the ability for both frame parts 210C, 210D to move relative to each other. With a slight pull directed against the magnetic force, the clamping force and the magnetic force may be overcome and the two parts 210C, 210D may be brought into the second coupling state again.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combinations of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A print head unit comprising:

a print head for ejecting droplets of a marking material;

an electronic print head controller electrically connected to the print head; and a coupling assembly for mechanically coupling the print head and the print head controller, wherein in an assembled state, the coupling assembly provides a first coupling state and a second coupling state, wherein in the first coupling state, the print head and the print head controller are fixed relative to each other, wherein in the second coupling state, the print head and the print head controller are enabled to move relative to each other within a range limited by the coupling assembly, wherein the print head unit is in the second coupling state when the print head unit is mounted in a carriage of a scanning inkjet printing assembly, and wherein the print head unit is in the first coupling state when the print head unit is not mounted.

2. The print head unit according to claim 1, wherein the coupling assembly comprises a snap-fastening mechanism, wherein the snap-fastening mechanism is fastened in the first coupling state and wherein the snap-fastening mechanism is decoupled in the second coupling state.

3. The print head unit according to claim 1, wherein the coupling assembly comprises a magnetic fastening mechanism, wherein in the first coupling state the magnetic fastening mechanism is arranged for generating a magnetic fastening force on the print head and the print head controller for driving them towards and/or against one another and wherein in the second coupling state the magnetic fastening force is reduced with respect to the first coupling state.

4. The print head unit according to claim 3, wherein the magnetic fastening mechanism comprises a magnetic element on one of the print head and the print head controller and a magnetisable element on the other of the print head and the print head controller, wherein the magnetic element and the magnetisable element are arranged, such that when near or adjacent one another the magnetic fastening force drives the magnetic element and the magnetisable element towards one another.

5. The print head unit according to claim 4, wherein the magnetic element and the magnetisable element are provided on correspondingly shaped mating parts of the print head and the print head controller for constraining movement of the print head with respect to the print head controller in a direction substantially perpendicular to the magnetic fastening force in the first coupling state.

6. A scanning inkjet printing assembly, the inkjet printing assembly comprising:

a carriage moveably arranged to scan over a recording medium, the carriage being provided with a first mounting mechanism and a second mounting mechanism; and a print head unit according to claim 1, the print head unit being mounted in the carriage, wherein the print head is engaged by the first mounting mechanism and the print head controller is engaged by the second mounting mechanism.

7. The scanning inkjet printing assembly according to claim 6, wherein the first mounting mechanism is configured to accurately position the print head relative to the carriage and to maintain such accurate position during printing, and wherein the second mounting mechanism is configured to hold the print head controller in a position relative to the print head within the limited range so as not to disturb the accurate position of the print head.

* * * * *